US009167909B2

(12) United States Patent
Cappadona et al.

(10) Patent No.: US 9,167,909 B2
(45) Date of Patent: Oct. 27, 2015

(54) MATTRESS

(71) Applicant: Carico International, Inc., Fort Lauderdale, FL (US)

(72) Inventors: Richard R. Cappadona, Boca Raton, FL (US); Igor Zunkovic, Dubai (AE)

( * ) Notice: Subject to any disclaimer, the term of this patent is extended or adjusted under 35 U.S.C. 154(b) by 0 days.

(21) Appl. No.: 14/221,345

(22) Filed: Mar. 21, 2014

(65) Prior Publication Data

US 2015/0265063 A1 Sep. 24, 2015

(51) Int. Cl.
*A47C 27/14* (2006.01)
*A47C 27/00* (2006.01)

(52) U.S. Cl.
CPC ..... *A47C 27/148* (2013.01); *A47C 27/002* (2013.01); *A47C 27/144* (2013.01)

(58) Field of Classification Search
CPC ..... A47C 27/14; A47C 27/15
USPC ..... 5/740, 736, 727, 655.9, 738
See application file for complete search history.

(56) References Cited

U.S. PATENT DOCUMENTS

| | | | | |
|---|---|---|---|---|
| 3,209,380 | A * | 10/1965 | Watsky | 5/724 |
| 4,053,957 | A * | 10/1977 | Regan | 5/727 |
| 4,606,290 | A | 8/1986 | Marzotto | |
| 5,088,136 | A | 2/1992 | Stryker et al. | |
| 5,173,531 | A | 12/1992 | Kissel | |
| 6,631,529 | B1 * | 10/2003 | Erickson | 5/738 |
| 6,683,779 | B2 | 1/2004 | Ober | |
| 7,191,483 | B2 * | 3/2007 | Hochschild | 5/740 |
| 8,209,804 | B2 | 7/2012 | Apperson et al. | |
| 2004/0242108 | A1 | 12/2004 | Russell et al. | |
| 2005/0115003 | A1 | 6/2005 | Torbet et al. | |
| 2005/0193497 | A1 * | 9/2005 | Baker | 5/721 |
| 2008/0098533 | A1 * | 5/2008 | Erdman | 5/722 |
| 2012/0110734 | A1 | 5/2012 | An | |
| 2012/0198618 | A1 | 8/2012 | Pavletic | |
| 2013/0082723 | A1 | 4/2013 | Locke | |

FOREIGN PATENT DOCUMENTS

| | | |
|---|---|---|
| CH | 705697 | 4/2013 |
| DE | 202007001720 | 6/2008 |
| EP | 1776901 | 4/2007 |

(Continued)

OTHER PUBLICATIONS

PCT International Search Report for PCT/US2015/022094, dated Jun. 17, 2015.

(Continued)

*Primary Examiner* — Fredrick Conley
(74) *Attorney, Agent, or Firm* — Jones Day

(57) ABSTRACT

A mattress core has front and rear ends that are spaced apart in a longitudinal direction and further has opposite sides that are spaced apart in a lateral direction. The core includes a firmer lower core section having a top surface that follows an undulating pattern. The undulating pattern is non-uniform and non-symmetric in the longitudinal direction, is uniform in the lateral direction, and includes at least one hill, at least one valley and at least one plateau. The core further includes a softer upper core section that overlies the lower core section. The upper core section has a bottom surface that follows the undulating pattern and contacts the lower core section's top surface to provide a common mating interface that follows the undulating pattern. The interface includes at least one hill, at least one valley and at least one plateau.

15 Claims, 7 Drawing Sheets

(56) References Cited

FOREIGN PATENT DOCUMENTS

| | | |
|---|---|---|
| JP | 2005 312649 | 11/2005 |
| WO | WO/2007/149260 | 12/2007 |

OTHER PUBLICATIONS

PCT Written Opinion for for PCT/US2015/022094, dated Jun. 17, 2015.

* cited by examiner

MATTRESS

TECHNICAL FIELD

This relates to bed mattresses.

BACKGROUND

A mattress is a cushioning device that typically overlies a bed frame or box spring and supports a person who is lying on the mattress.

SUMMARY

An example mattress core has front and rear ends that are spaced apart in a longitudinal direction and further has opposite sides that are spaced apart in a lateral direction. The core includes a firmer lower core section having a top surface that follows an undulating pattern. The undulating pattern is non-uniform and non-symmetric in the longitudinal direction, is uniform in the lateral direction, and includes at least one hill, at least one valley and at least one plateau. The core further includes a softer upper core section that overlies the lower core section. The upper core section has a bottom surface that follows the undulating pattern and contacts the lower core section's top surface to provide a common mating interface that follows the undulating pattern. The interface includes at least one hill, at least one valley and at least one plateau.

In this example, the upper core section has a top surface and the lower core section has a bottom surface. At least thirty air channels extend, within the core, from the lower core section's bottom surface to the upper core section's top surface. The lower section has a bottom surface and laterally opposite first and second side surfaces. Internal grooves project downward from the lower core section's top surface and extend laterally from the first side surface to the second side surface. A series of laterally-extending external upper grooves project downward from the upper core section's top surface. The core includes an indication that indicates to a user which of the sections is the firmer section. The core includes a color boundary along the interface, defined by a difference in color between the softer upper core section and the firmer lower core section, that corresponds to a graph of firmness versus longitudinal position along the core. The core includes an indication that distinguishes, for a user, the front end from the rear end. A flexible encasement encases the core. The encasement includes a top panel, a bottom panel, a front panel, a rear panel, and two opposite side panels. Each panel is electrically conductive, flame retardant and antibacterial.

DETAILED DESCRIPTION

Figure 1:
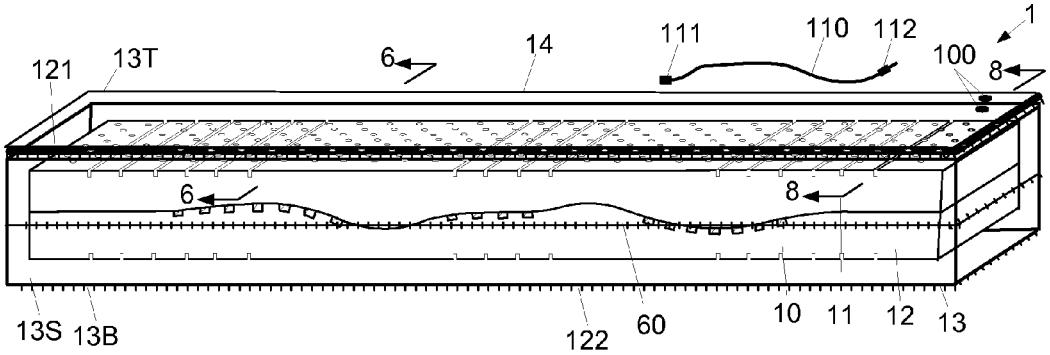
FIG. 1 is a perspective view of an example mattress.
Figure 2:
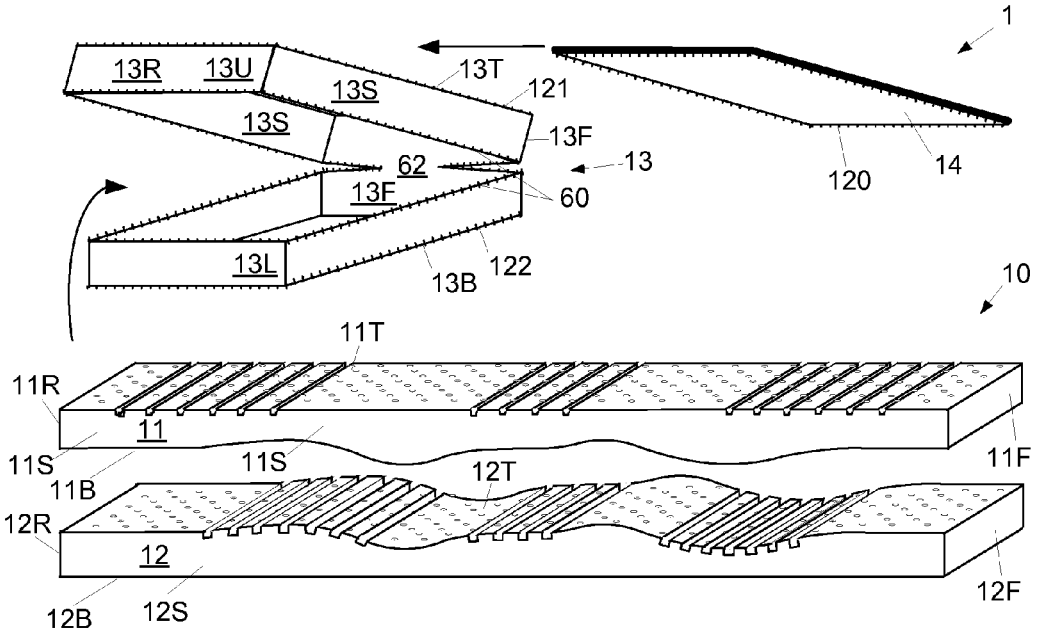
FIG. 2 is an exploded view of the mattress.

FIGS. 1 and 2 respectively show an assembled view and exploded view of an example bed mattress 1, which might typically overlie a bed frame, box sprint or other flat surface (e.g., floor). The mattress 1 includes a foam core 10 comprising an softer upper core section 11 and a firmer lower core section 12, encased in a flexible encasement 13, and topped by a flexible topper pad 14.

Figure 3:
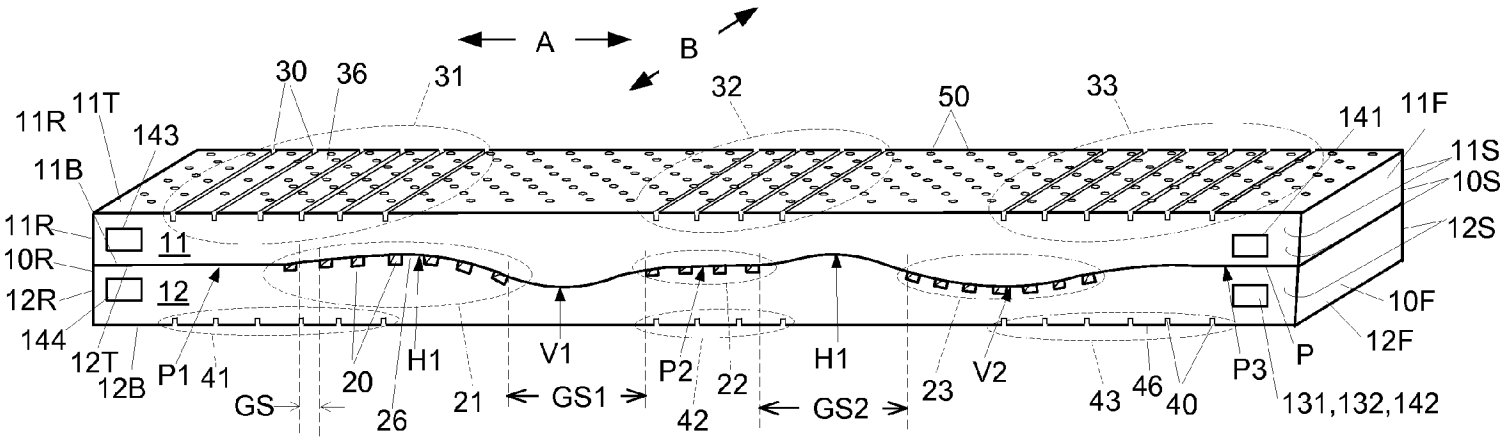
FIG. 3 is a perspective view of a core of the mattress.

Referring to FIG. 3, the softer and firmer core sections 11, 12 are made of Elio-cell foam, which is an open-cell breathable polyurethane foam. The softer core section 11 overlies the firmer section 12, with reference to the core's orientation shown in FIGS. 1-2. The softer upper core section 11 has six peripheral surfaces: a top surface 11T, a bottom surface 11B, a front end surface 11F, a rear end surface 11R and two opposite side surfaces 11S. Similarly, the firmer lower core section 12 has six peripheral surfaces: a top surface 12T, a bottom surface 12B, a front end surface 12F, a rear end surface 12R and two opposite side surfaces 12S. All of the core's peripheral surfaces are planar, except for the softer core section's bottom surface 11B and the firmer core section's top surface 12T.

In the following description of mattress components, a "longitudinal" direction (arrow "A" in FIG. 3) extends from the front surface 11F to the rear surface 11R and is parallel with the side surfaces 11S. A "lateral" direction (arrow "B" in FIG. 1) extends from one side surface 11S to the other side surface 11S and is parallel with the front surface 11F and the rear surface 11R.

As shown in FIG. 3, the softer upper section's bottom surface 11B and firmer lower section's top surface 12T share a common nonuniformly undulating pattern P. These surfaces 11B, 12T are mating surfaces that matingly contact each other (are adjoined) along their entire lengths and widths to define an interface that embodies the common pattern P. The mating contact may be non-adhering and removable, by surface 11B simply resting on surface 12T. Or the mating contact may be adhering contact, such as by adhesive or melting. The softer core section's front, rear and side surfaces 11F, 11R, 11S are respectively coextensive with the firmer core section's front, rear and side surfaces 12F, 12R, 12S, so that each peripheral surface—front, rear and side 10F, 10R, 10S—of the core 10 is flat (planar) from top 10T to bottom 10B and from front 10F to rear 10R.

The interface pattern P is undulating in the longitudinal direction A. The pattern P is uniform in the lateral direction B, such that that an intersection of the interface P with a vertical laterally-extending plane at any longitudinal location yields a straight horizontal line.

The undulating pattern P has three types of features: plateaus P1, P2, P3; hills H1, H2; and valleys V1, V2. The locations of these core features in this example can be defined by the following approximate X,Y coordinates, in centimeters, with respect to a coordinate origin (0,0) located at the rearmost point of the interface. The core's top surface 11T is uniformly 9 cm above the origin. The core's bottom surface 12B is uniformly 13 cm below the origin. P1 (first plateau)

extends from (0,0) to (32,0). H1 (first hill) extends from (32,0) to (64,0) and peaks at (47,3). V1 (first valley) extends from (64,0) to (88,0) and is deepest at (76,−3). P2 extends from (88,0) to (107,0). H2 extends from (107,0) to (135,0) and peaks at (123,2). V2 extends from (135,0) to (168,0) and is deepest at (152,−3). P3 extends from (168,0) to (200,0).

These features of the interface pattern P are located with respect to parts of a body of an adult person lying on the mattress 1 with his/her head adjacent the front surface. P1 is configured to be under a person's feet. H1 is configured to be under the person's leg calves. V1 is configured to be under the person's thigh. P2 is configured to be under the person's buttocks. H2 is configured to be under the person's back. V2 configured to be under the person's shoulders. P3 is configured to be under the person's head. The undulatory interface pattern, combined with the difference in firmness between the softer and firmer core sections, helps keep the spine and legs of a person, while lying on back, side or stomach, straighter than if the interface pattern P was planar. The undulating pattern P also augments the interface adhesive's function of reducing longitudinal movement of the softer core section 11 relative to the firmer core section 12.

The firmer core section's top surface 12T is interrupted by three groups 21, 22, 23 of laterally-extending internal grooves 20. In this example, the first group 21 is located below where the person's leg calves would be. The second group 22 is located below where the person's pelvis would be. The third group 23 is located below where the person's shoulders would be. The first group 21 extends only along plateau P1 and hill H1 (mentioned above). The second group 22 extends only along plateau P2. The third group 23 extends only along valley V2.

In this example, the internal grooves 20 are alike. Each groove 20 extends laterally from one side surface 12S of the firmer section 12 to the opposite side surface 12S. A first group-spacing distance GS1 between the first and second groups 21, 22, and a second group-spacing distance GS2 between the second and third groups 22, 23 are each at least five times the groove-spacing distance GS between neighboring internal grooves 20 within each group 21, 22.

In this example, the first, second and third groups 21, 22, 23 respectively have seven, four and seven internal grooves 20. GS is about 2 cm, GS1 is about 35 cm, and GS2 is about 31 cm. The first group 21 is spaced about 31 cm from the rear surface 10R, and the third group 23 is spaced about 35 cm from the front surface 10F.

Figure 4:
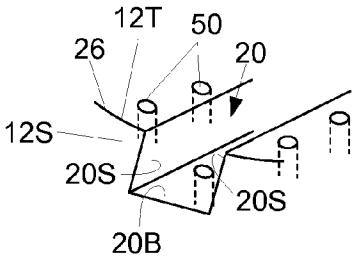
FIG. 4 is an expanded view of a top surface of a lower section of the core.

FIG. 4 is an expanded view of one of the internal grooves 20. Each internal groove 20 has a rectangular cross-section, with planar side surfaces 20S that are about 1.5 cm deep (measured from the firmer core section's top surface 12T). Each internal groove 20 further has a planar base surface 20B that is 2 cm wide and parallel with the firmer core section's top surface 12T in the vicinity of the groove 20.

As shown in FIG. 3, the groove-spacing distance GS, which is the spacing between adjacent grooves 20 within each group is about 3 cm. In this example, the firmer lower core section 12 has at least ten grooves 20, and each groove 20 is at least 0.6 cm deep and at least 1.3 cm wide, and has a ratio of depth to width in the range 0.25-0.75. Unlike the firmer core section's top surface 11T, the groove's base surface 20B does not adjoin or support the softer core section 11 but is instead spaced vertically away from the top core section 11.

The areas of the mattress 1 that are directly over the internal groove groups 21, 22, 23 will feel less firm to a person lying on the mattress 1, and will deflect more under the person's weight, than areas of the mattress 1 that are not directly over the groove groups 21, 22, 23. This helps the user's legs, calves, pelvis and shoulders sink more deeply into the mattress 1 than other parts of the person's body. The combination of the firmness difference between the softer and firmer core sections 11, 12, the undulating interface pattern P, and the groove configuration are together designed to help keep the person's spine and legs straight.

Between each adjacent pair of internal grooves 20 is an internal upward projection 26 of the foam material of the lower core section 12. Each projection 26 extends laterally from one side 12S of the lower core section 12 to the opposite side 12S. Each projection 26 is bounded longitudinally by neighboring grooves 20 and is bounded from above by, and adjoins, the upper core section's bottom surface 11B. The projections 26 laterally reinforce the lower core section's top surface 12T, which tends to keep to the profile of core 10 in the lateral direction more uniform than its profile in the longitudinal direction. When the core's top surface 11T deflects downward under the weight of a person, the projections 26 reduce the downward bow in the lateral direction but not in the longitudinal direction.

The top surface 11T of the core 10 in this example is interrupted by three groups of laterally-extending external upper grooves 30. The upper grooves 30 are alike in size and shape. Each upper groove 30 extends laterally from one side surface 11S of the core 10 to the opposite side surface 11S. The first upper group 31 is located under where the person's feet would be, and is longitudinally centered approximately directly above the rearmost one of the internal grooves 20. The second upper group 32 is located under where the person's pelvis would be, and is longitudinally approximately centered directly above the longitudinal center of the second internal groove group 22. The third upper group 33 is located under where the person's head would be, and is longitudinally approximately centered directly above the frontmost one of the internal grooves 20.

The bottom surface of the lower core section 12 in this example is also interrupted by three "lower" groups 41, 42, 43 of laterally-extending lower external grooves 40, identical in number, size, shape and longitudinal positioning as the upper external grooves 30.

All of the external grooves 30, 40 are alike. They are described as follows with reference to one of the upper external grooves 30 shown in FIG. 5. Each external groove 30 has planar side surfaces 30S that are vertical (i.e., perpendicular to the top surface 11T) and a circular base surface 30B. Each external groove 30 is about 1.3 cm deep and about 0.3 cm wide, yielding a depth-to-width ratio of about 4.0, and its circular base surface follows a 0.4 cm radius. The external grooves 30 are longitudinally spaced apart on approximately 3 cm centers, leaving about 5.6 cm between neighboring grooves 30. The ratio of groove on-center spacing to groove depth is about 5. The external grooves (30 when the softer core section 11 is on top, and 40 when the firmer core section 12 is on top) provide a softer, more cushiony, feel to the person's body, especially at the pressure points of the feet, pelvis and head, by enabling the core section's external surface to conform to a person's body curves better than if the grooves were absent.

Each adjacent pair of external upper grooves 30 defines an external upper projection 36 of foam material of the upper core section 11. Similarly, each adjacent pair of external lower grooves 40 defines an external lower projection 46 of the foam material of the lower core section 12. Each external projection 36, 46 extend laterally from one side 10S of the core 10 to the opposite side 10S of the core 10. The projections 36, 46 reinforce the core 10 in the lateral direction and not in the longitudinal direction.

Figure 5:
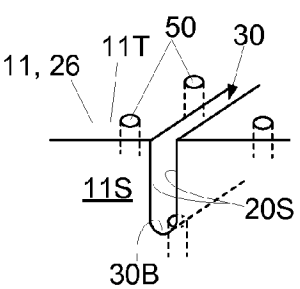
FIG. 5 is an expanded view of a top surface of an upper section of the core.

As shown in FIGS. 3-5, the core 10 has an array of vertical air channels 50. In this example, the channels 50 are alike. Each channel 50 extends vertically from the core's bottom surface 12B to the core's top surface 11T. Each channel 50 is cylindrical, with a diameter of approximately 0.6 cm, and extends straight through both sections 11, 12 of the core 10. The channels 50 can be made by boring the core 10 after the core's softer and firmer sections 11, 12 are adhered together. The channels 50 are arranged in an array (matrix), with rows perpendicular to columns, and with the rows and the columns both evenly spaced apart by a same distance, which in this case is about 2.8 cm. The array is angled at 45 degrees to both the longitudinal direction and the lateral direction. Therefore, the channels 50 are spaced apart by approximately 4 cm with reference to the lateral direction and with reference to the longitudinal direction. The number of channels 50 is preferably at least thirty.

Figure 6:
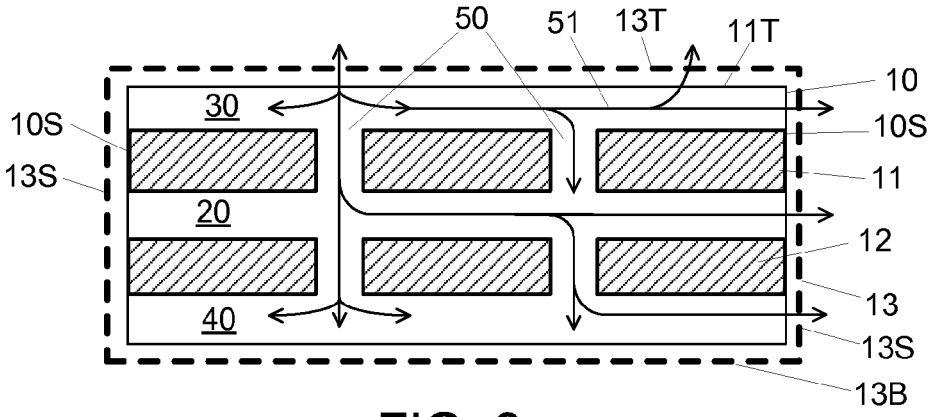
FIG. 6 is a schematic sectional view of the mattress, taken at line 6-6 of FIG. 1, illustrating airflow paths in the mattress.

FIG. 6 illustrates possible airflow paths 51 through the grooves 30, 40 and channels 50. As shown, air can flow both left and right through the horizontal grooves 30, 40 and both upward and downward through the vertical channels 50. Most of the vertical channels 50 terminate at the core's top and bottom surfaces 11T, 12B. Some vertical channels 50 terminate in the external grooves 30, 40, in that some extend downward from one of the external upper grooves 30 to the bottom 12B and upward from one of the lower grooves 40. Some vertical channels 50 are intercepted by the internal grooves 20. This provides many possible airflow paths 51, which ultimately extend through the porous panels (13T, 13B, 13F, 13R and 13S) of the encasement 13. Which airflow paths are active and which directions air flows through the active paths can depend on how the mattress is compressed and released with body movements. The airflow 51 can be caused by bellows action or peristaltic pump action due to moving body compression of the grooves 30, 40 and channels 50. The airflow 51 can also be caused by air temperature differentials between different zones of the core 10.

As shown in FIG. 2, in this example, the encasement 13 encases the core 10 in that it covers all six sides (top, bottom, front, rear and two sides) of the core 10. The encasement 13 has six flexible panels: a top panel 13T, a bottom panel 13B, and four peripheral panels comprising a front panel 13F, a rear panel 13R and two side panels 13S. The peripheral panels are adjoined (e.g., stitched) along their top edges to the top panel 13T and along their bottom edges to the bottom panel 13B. The top panel 13T is softer (less firm, less stiff) than the bottom panel 13B.

A zipper 60 (portrayed as two separated zipper halves in FIG. 2) is vertically centered between the upper and lower panels 13U, 13L. The zipper 60 extends horizontally around the entire periphery of the encasement 13, except for a living hinge section 62 of the front panel 13F. The living hinge 62 is located between opposite ends of the zipper, which are spaced laterally apart by a spacing distance in the range 8-16 cm. The encasement 13 includes an upper section 13U located above the zipper 62 and a lower section 13L located below the zipper 62. As shown in FIG. 2 a user may unzip the zipper 60 and lift the encasement's upper section 13U from its lower section 13L about the living hinge 62, to insert the core 10 into the encasement 13 or remove the core 10 from the encasement 13.

Figure 7:
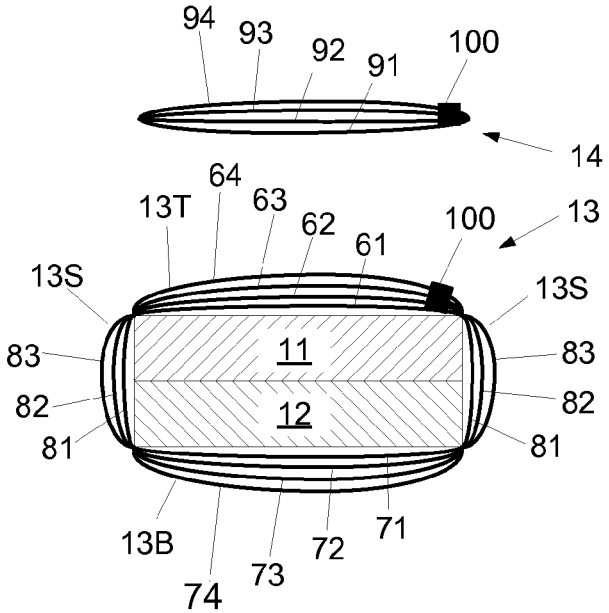
FIG. 7 is a section view of the mattress, taken at line 8-8 in FIG. 1.

As shown schematically in FIG. 7, each panel 13T, 13B, 13F, 13R, 13S of the example encasement 13 includes four layers that are stitched together both along their peripheries and also along meandering paths (not shown) that are spaced away from the peripheries.

The encasement's top panel 13T has the following four layers:

The first (lowest and closest to the core) layer 61 of the top panel 13T is a carbon fabric, comprising a 48% polypropylene, 46% polyester, 5.5% polyamid and 0.5%/carbon fabric. The carbon enhances electrical conductivity. The electrical conductivity of this layer 61 provides EMF shielding. It also provides electrical grounding when connected to a grounding terminal.

The second layer 62 of the top panel 13T is an open cell memory foam. It is a memory foam in that is viscoelastic (low-resilience). It releases pressure points on the body and does not restrict or constrict blood circulation. Its open cell structure enables fresh air to enter the mattress, and does not retain moisture, which reduces bacteria, mold and odors.

The third layer 63 of the top panel 13T is a flame barrier. It may comprise a blend of 90% viscose fire retardant yarn and 10% polyester.

The fourth (outer) layer 64 of the top panel 13T is a CLIMA 3-D AIR CHAMBER fresh air system. It is a flexible pad comprising an upper sheet, a lower sheet and microfibers. Each microfiber projects vertically upward from the lower sheet to the upper sheet to space the upper sheet from the lower sheet. The fibers have a density of tens of thousands of fibers per square inch. The fibers create tiny air chambers which allow the mattress to regulate body temperature, keeping the mattress and the person's body cooler in summer and warmer in winter. The fibers also relieve pressure points on the body.

The bottom panel 13B of the encasement 13 has the following four layers:

The first (closest to the core) layer 71 of the bottom panel 13B is the carbon fabric described above. It enhances electrical conductivity and reduces EMF.

The second layer 72 of the bottom panel 13B is a 100% polyurethane foam 6.5 mm thick.

The third layer 73 of the bottom panel 13B is the flame barrier described above.

The fourth layer 74 of the bottom panel 13B is a forial cover fabric. It has a fire retardant treatment. It also has silver fibers that enhance electrical conductivity and inhibit bacteria growth and odors. The electrical conductivity of this layer 74 provides EMF shielding. It also provides electrical grounding when connected to a grounding terminal.

The peripheral panels 13F, 13R, 13S share the same three layers. They are described as follows with reference to the side panels 13S shown in FIG. 7:

The first (closest to the core) layer 81 of the side panel 13S is the carbon fabric described above.

The second layer 82 of the side panel 13S is the flame barrier described above.

The third layer 83 of the side panel 13S is a forial cover fabric, like the forial cover fabric described above. It has a fire retardant treatment. It also has silver fibers that enhance electrical conductivity and inhibit bacteria growth and odors.

Each panel 13T, 13B, 13F, 13R and 13S of the encasement 13 includes an electrically conductive layer and is thus itself electrically conductive. This reduces static electricity and static shocks, and also shields the person (lying on the mattress) from electromagnetic fields (EMF) generated within the home (e.g., by electrical wiring and electronic devices within the home) and EMF generated outside the home (e.g., radio signals).

As shown in FIG. 1, the mattress topper 14 has the same peripheral size and shape as the encasement 13. The topper 14 is configured to be placed on the encasement 13 to provide extra comfort, electrical conductivity, and bacterial inhibition. It also reduces pressure points on the core 10 and encasement 13 to increase their service life.

With reference to FIG. 7, the topper 14 has the following four layers:

The first (lowest, closest to the encasement) topper layer 91 is a blend of 51% polypropylene and 42% polyester, interwoven with 4.5% Lurex silver fibers and 2.5% polyester silver fibers. The silver fibers enhance electrical conductivity and inhibit bacterial growth, creating a 99.9% bacterial free environment. This layer 91 provides EMF shielding. It also provides electrical grounding when connected to a grounding terminal.

The second topper layer 92 is an open cell polyurethane foam pad. It is a "memory" foam in that it is viscoelastic (low-resilience). It has silver ions that inhibit bacteria growth (yielding 99.9% bacteria free environment) and odors, which would otherwise be enhanced to the person's warm sweat. It also releases body pressure points and enables improved blood circulation. Its open cell arrangement allows fresh air to enter the mattress. This layer 92 also does not retain moisture, which further reduces the occurrence of bacteria, mold and odors.

The third topper layer 93 is a flame barrier like the flame barrier described above.

The fourth (top) topper layer 94 is a forial cover fabric described above.

The topper 14, like the encasement 13, includes electrically conductive layers and is thus itself electrically conductive. This reduces static electricity and static shocks, and also shields the person (lying on the mattress) from electromagnetic fields (EMF) generated within the home (e.g., by electrical wiring and electronic devices within the home) and EMF generated outside the home (e.g., radio signals).

The encasement 13 and the topper 14 can each be electrically grounded as follows. Metal grounding terminals 100, in this example electrical connector buttons, are attached (e.g., riveted) to the encasement 13 and to the topper 14. The mattress 1 may be supplied with at least one electrical grounding wire cable 110 (cord) (FIG. 1). In this example, the grounding cable 110 has a clip terminal 111 at one end that can connected to (e.g., snapped onto) any one of the grounding buttons 100. The cable 110 has a ground terminal 112 at its opposite end that can be connected (attached) to an electrical ground (grounded metal, grounding source) to ground the encasement 13 and/or topper 14. The ground terminal 112 might be, for example, an adapter plug with a prong that can be plugged into a ground terminal of a wall socket, which can be used with a wall socket of any voltage (e.g., 110 VAC, 220 VAC). The ground terminal 112 might include an alligator clip to be connected to any grounding source. An example grounding source is a metal water pipe. Another example grounding source is a metal rod that may be sold to the user along with mattress, for the user to embed into the earth him/herself. The cable 110, when connected to the buttons 100 of the encasement 13 and/or the topper 14, grounds the encasement 13 and the topper 14 and the person lying on them. The grounding reduces static electricity and static shocks, and also improves the EMF shielding.

When the mattress user plans to travel and stay overnight at a location away from home, he/she may roll up the topper 14 and cable 110 and take them along on the trip. The person may lie the topper 14 over a mattress where the person is lodging, and use the cable 110 to ground the topper 14. The topper 14 will then provide the benefits of bacteria inhibition, extra comfort, EMF shielding and electrical grounding to the person while away from home. Those same benefits are provided to a person lying on the encasement 13 without the topper 14 present. The topper 14 and cable 110 may be purchased even without the mattress, and laid on any surface (e.g., a standard mattress) to obtain the advantages that the topper 14 provides.

As shown in FIG. 2, the topper 14 is configured to be removably attached to the encasement by zipper halves 120, 121. One zipper half 120 extends about the entire periphery of the topper 14. A mating zipper half 121 extends about the entire periphery of the encasement's top panel 13T, for attaching (zipping) the topper 14 to the encasement's top panel 13T if desired. Another mating zipper half is 122 extends about the entire periphery of the encasement's bottom panel 13B, for attaching (zipping) the topper 14 to the encasement's bottom panel 13B in case the user inverts (flips upside down) the encasement 13 and sleeps on the bottom panel 13B.

The mattress 1 can provide four user-selectable levels of firmness when lying on the mattress 1. This is enabled by three factors: (1) The encasement's top panel 13T is softer than its bottom panel 13B. (2) The difference in firmness between the softer and firmer core sections 11, 12 is more pronounced than the difference in firmness between softer and firmer encasement panels 13T, 13B. (3) The zipper 90 enables the core 10 to be easily removed from the encasement 13 and inverted and reinserted. Extra soft level is achieved by having the softer core section 11 and the softer encasement panel 13T on top. Medium soft is achieved by having the softer core section 11 and the firmer encasement panel 13B on top. Medium firm is achieved by having the firmer core section 12 and the softer encasement panel 13T on top. Extra firm is achieved by having the firmer core section 12 and the firmer encasement panel 13B on top.

Figure 8:
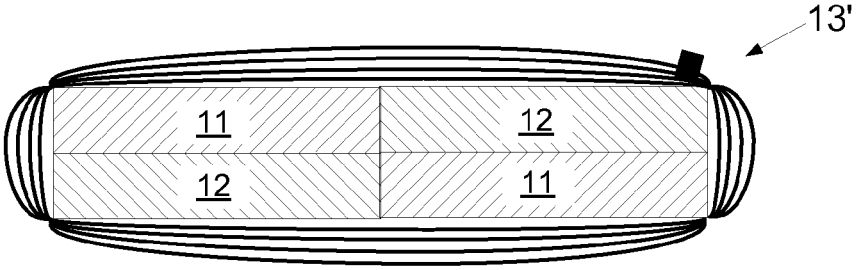
FIG. 8 is a sectional view, similar to FIG. 8, showing a second example mattress having two cores like the core shown in the FIGS. 1-8.

FIG. 8 shows a second example mattress 13' that is best suited for king and queen size. This mattress 13' includes two cores 10, each like the core 10 described above, lying side by side within a single encasement 13 like the encasement described above. One person can lie above one core 10 and another person can lie above the other core 10. Each core 10 can be inverted (in the manner a described above) independent of the orientation of the other core 10 and independent of the orientation of the encasement 13. This provides independently-adjustable comfort zones for the two people laying on the mattress 13'. For example, in FIG. 8, one core 10 has its softer section 11 on top, and the other core 10 has its firmer section 12 on top. Since three components—the encasement 13 and the two cores 10—has two orientations (upright and inverted), this second mattress 13' provides eight firmness configurations.

Referring to FIG. 3, the firmness felt by the user depends on which core section 11, 12 is on top. Therefore, the core 10 may include indications that indicate (distinguish) to a user which core section is the firmer section 12 and which is the softer section 11. In FIG. 3, the indication includes a marking 131, such as text imprinted on the core's foam itself or imprinted on labels adhered to the core's foam, stating "FIRMER SECTION" or "SOFTER SECTION". The indication may also include a difference in color between the softer section 11 and the firmer section 12, with the user being informed which color corresponds to which core section.

As described above regarding FIG. 3, the undulating interface pattern P of the interface 11B provides different firmnesses at longitudinally-different locations along the top surface 11T. Since the lower core section 12 is firmer than the upper core section 22, firmness at any location along the core 10 is a positive function of thickness of the lower core section 12 at that location. So, for example, the core 10 is firmer over the hills H1, H2 than over the valleys V1, V2. Since the core's interface pattern P is not longitudinally symmetric, neither is the core's firmness pattern P. Therefore, a user lying in a forward orientation with his/her head adjacent the core's front end 10F would experience a different feel than a user lying in a reverse orientation with his/her head adjacent the rear end 10R. For example, in the forward orientation, the user's shoulders are over a valley (V2), which provides extra softness that lets the shoulders sink lower into the core 10 than the rest of the body, which helps keep the user's spine straight. In contrast, if the user lies in the reverse orientation, his/her shoulders will be over a hill (H1) which provides extra firmness that resists the shoulders sinking into the core 10.

Accordingly, the feel of the mattress 10 depends on the person's longitudinal orientation relative to the core 10. Therefore, the core 10 may include an indication 132 that differentiates (distinguishes), for the user, the core's front 11F from its rear 11R. The indication might include markings 132 on the core 10, such as text on a label stating "HEAD HERE", "FEET HERE", "FRONT END" or "REAR END". The indication might also include highlighting of the path P of the interface. This highlighting may be achieved by the upper core section 11 having a different color than the firmer core section 12 (as described above), so that the boundary between the two colors follows the interface. The user may also recognize from the pattern of the color boundary which end is front and which is rear. Also, since the user realizes that firmness at any location is a positive function of the height of the color boundary (with reference to the firmer core 12 section being on the bottom), the color boundary serves as a graph of the core's firmness versus longitudinal location. The graph reveals the core's firmness pattern, so the user can make an informed decision as to what location (of the mattress) and what longitudinal orientation he/she should lie or sit in.

The inventors have found that, counter-intuitively, the preferred lying orientation (based on comfort) among people who have tried out this mattress, tends to depend on which of the core sections is on top. Specifically, people prefer the forward orientation (head at core's front end 10F) when the softer core section 11 is on top, and prefer the reverse orientation (head at core's rear end 10R) when firmer core section 12 is on top. Therefore, the core 10 may include markings, such as imprinted on the core foam or on labels, that indicate which user orientation is recommended for which orientation. For example, a first marking 141 at the soft section's front end 11F might state "HEAD HERE", and a second marking 142 just below the first marking at the firm section's front end 12F stating "FEET HERE" upside down relative to the first marking Conversely, a third marking 143 at the soft section's rear end 11F might state "FEET HERE", and a fourth marking 144 just below the third marking might state "HEAD HERE" upside down relative to the third marking.

Figure 9:
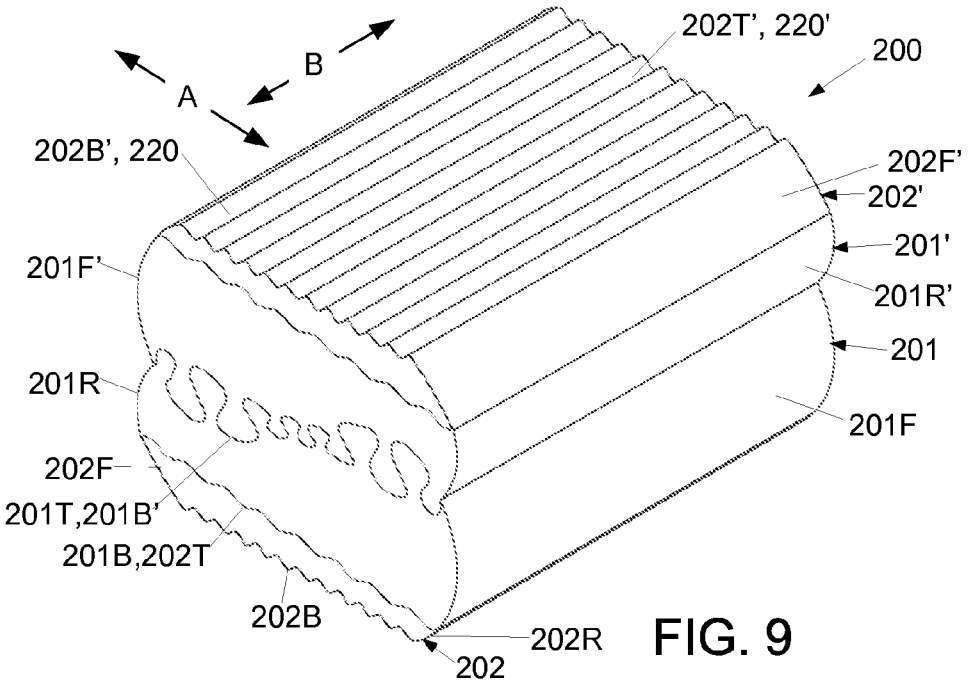
FIG. 9 is a perspective view of a pillow assembly that is well suited for use with the mattress.
Figure 10:
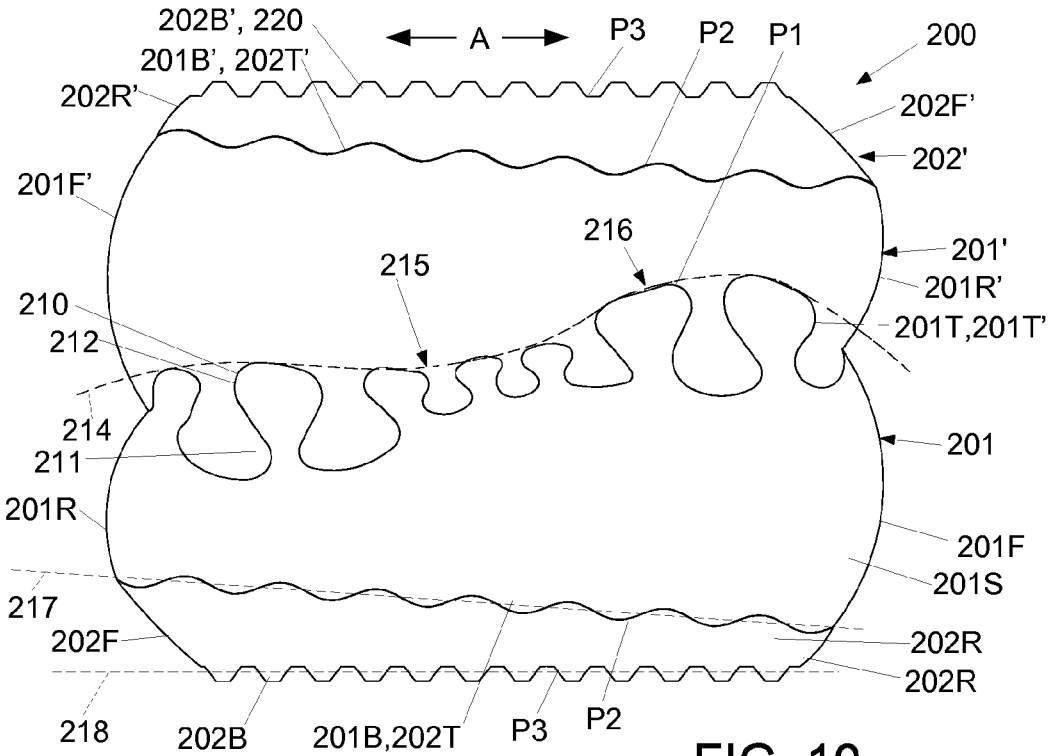
FIG. 10 is a side view of the pillow assembly.
Figure 11:
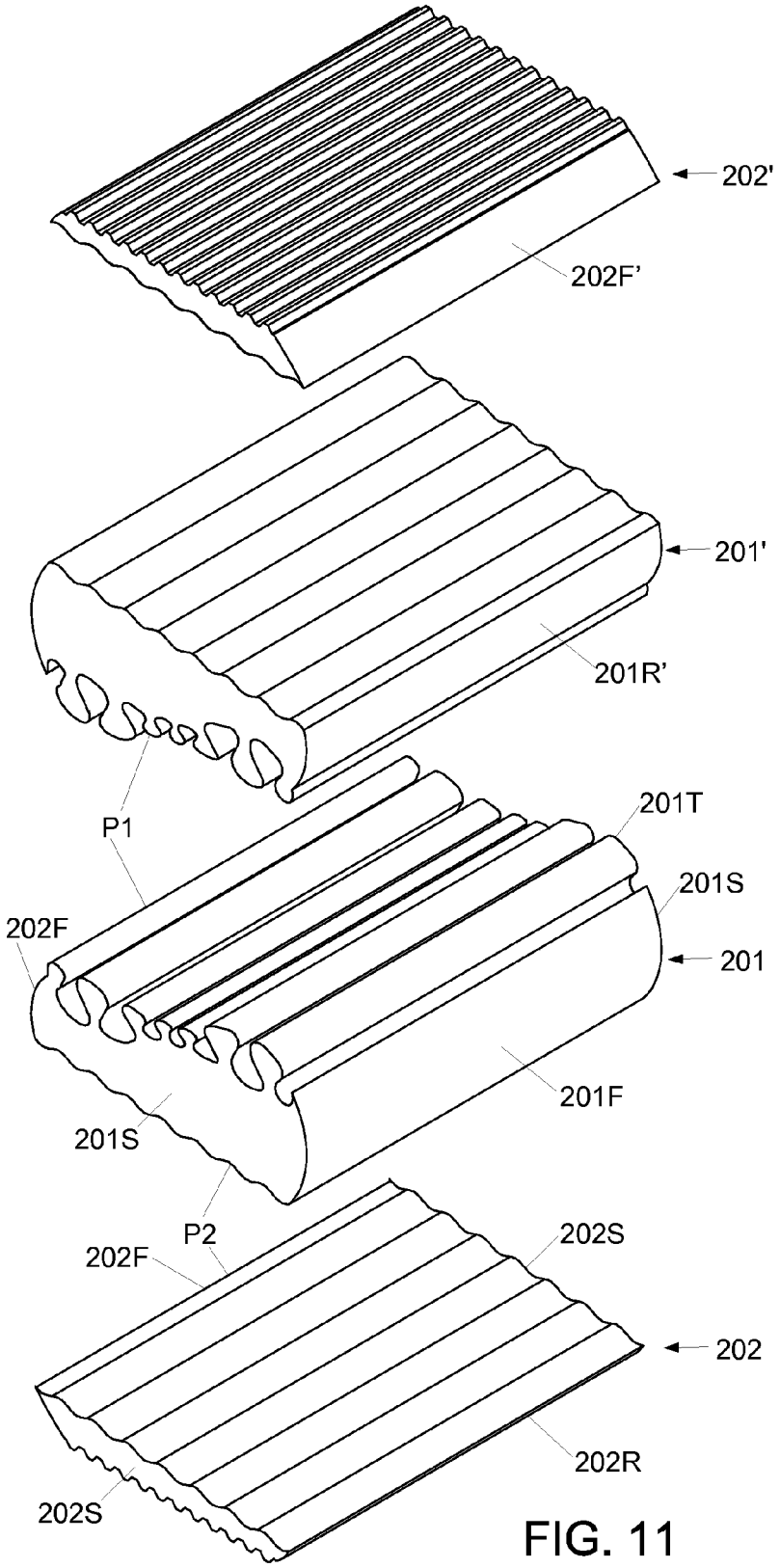
FIG. 11 is a perspective exploded view of the pillow assembly.

The above description regarding the mattress of FIGS. 1-8, and the following description regarding an accompanying pillow assembly of FIGS. 9-11, include prefaces with directional terms of "front" and "rear", "upper" and "lower" and "top" and "bottom". These designations are made only with reference to how the components may be oriented in the figures, and can be equivalently replaced with "first" and "second". This is exemplified by the fact that, as explained above, the components can be used in inverted orientations in which the "lower" or "bottom" component is above the "upper" or "top" component.

Figure 12:
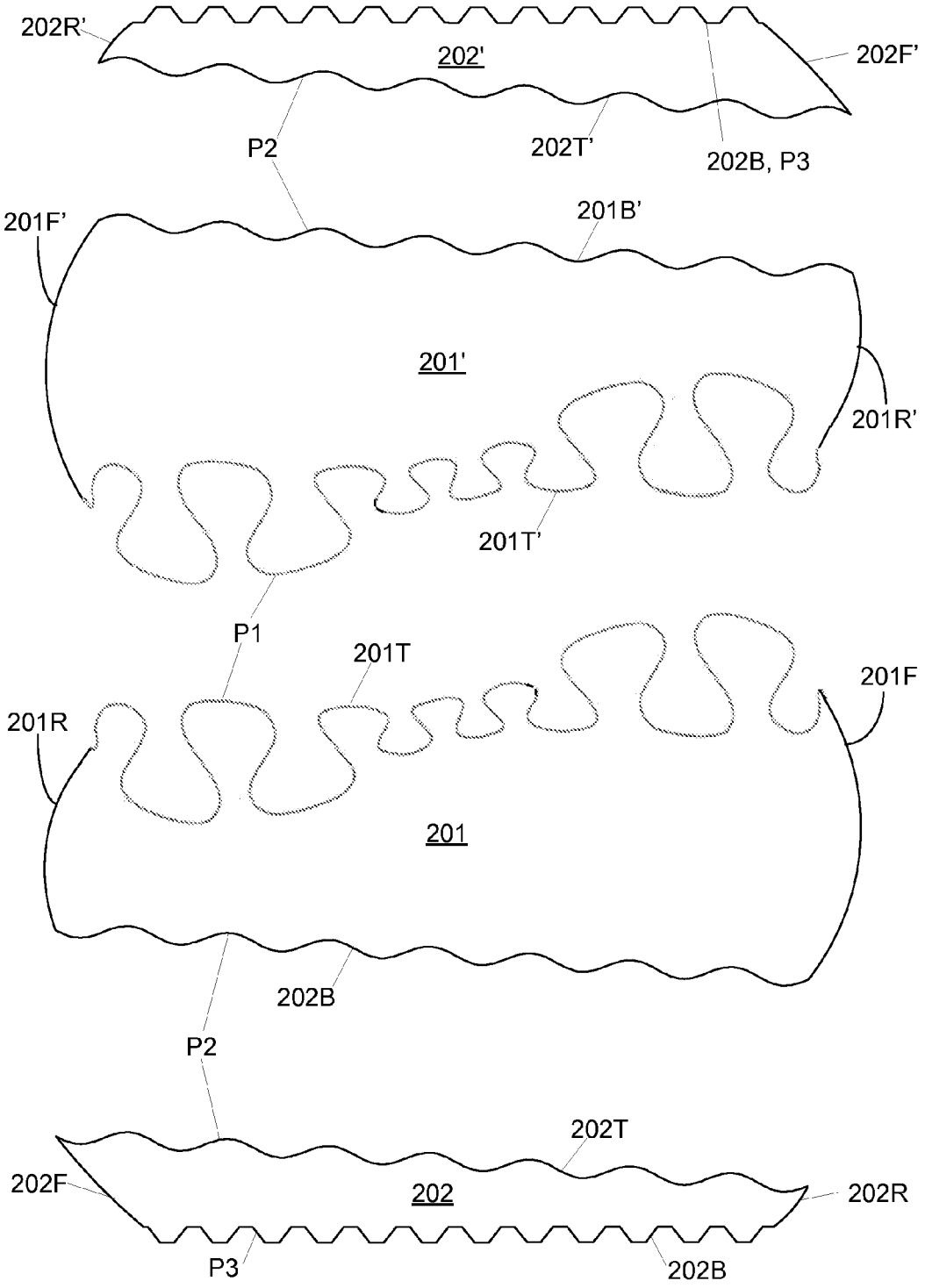
FIG. 12 is an exploded side view of the pillow assembly.

FIGS. 9-12 show an example pillow assembly 200 that is well suited for use with the mattress of FIGS. 1-8. FIGS. 9 and 10 are respectively a perspective assembled view and a side assembled view of the pillow assembly 200. FIGS. 11 and 12 are respectively an exploded perspective view and an exploded side view of the pillow assembly 200. As shown in FIGS. 9-12, the pillow assembly 200 includes first and second main pillows 201, 201' and first and second auxiliary pillows 202, 202' that are stacked together.

The main pillows 201, 201' are alike, and the auxiliary pillows 202, 202' are alike. All four pillows are made of Eliocell open cell polyurethane foam. The foam of the main pillow 201 may be of the same firmness as the foam of the auxiliary pillow 202. It may alternatively be more firm than the foam of the auxiliary pillow 202. It may alternatively be less firm than the foam of the auxiliary pillow 202.

The following description of the pillow assembly 200 is made with reference to a longitudinal direction (arrow "A") and a lateral direction (arrow "B"). The longitudinal direction A is the direction along which a user would typically lie when resting his/her head on the pillow assembly.

Referring to FIG. 10, the main pillows 201, 201' in this example are identical (same size and shape), and described as follows with reference to the first main pillow 201. The main pillow 201 is generally wedge shaped, in that it has a taller front end surface 201F and a longitudinally opposite shorter rear surface 201R. It also has a top end surface 201T and a bottom end surface 201B. It also has two laterally opposite planar parallel planar side surfaces 201S. In this example, the main pillow 201 is about 32 cm wide in the longitudinal direction, about 17 cm tall at its highest point, and about 66 cm long in the lateral direction.

The top surface 201T of the main pillow 201 follows a longitudinally undulating first pattern P1 that is very pronounced and nonuniform and not longitudinally symmetrical. The bottom surface 201B follows a longitudinally undulating second pattern P2 that is less pronounced than the first pattern P1. Both the top and bottom surfaces 201T, 201B undulate only in the longitudinal direction A, and are uniform in the lateral direction B. The front and rear surfaces 201F, 201R are concave and are uniform in the lateral direction B. The two side surfaces 201S are flat, vertical and parallel.

The first pattern P1 is common to both main pillows' top surfaces 201T. The first pattern P1 includes a longitudinal series of projections 210. Each projection includes a neck 211 and a bulbous head 212 that is wider (laterally) than the neck 211. The pattern P1 is configured for the top surfaces 201T, 201T' to interleavingly mate (dovetail) with each other if, and only if, one of them is vertically inverted (upside down) and longitudinally flipped so that the front end 201F' of one overlies the rear end 201R of the other. In this mating configuration, each bulbous head 212 of each main pillow 201, 201' fits perfectly between two necks 212 of the other pillow, to provide the dovetail arrangement. This dovetailing capability is counterintuitive in view of the apparently wildly random (haphazard) path that the pattern P1 follows.

The tops of the projections 210 define a smooth curve 214 that is concave 215 along half of the main pillow 201 and convex 216 along another half of the pillow 201. This provides a user with an option for his/her head to rest in the concave section 215 and the convex section 216.

The second pattern P2, which is common to the main pillows' bottom surfaces 201B, 201B', is configured for the bottom surfaces 201B, 201B' to interleavingly mate (dovetail) with each other when one of them is vertically inverted, whether or not it is flipped longitudinally.

The second pattern P2 is longitudinally uniform in that it is substantially a sine-wave shaped, with a repeating wave motif. The repeating motif has a uniform amplitude and period, and is centered on a longitudinal straight line 217.

The auxiliary pillows 202, 202' are the same, and described as follows with reference to the first auxiliary pillow 201 shown in FIG. 11. The auxiliary pillow 202 is generally wedge shaped, in that it has a taller front end surface 202F and a longitudinally opposite shorter rear end surface 202R. It also has a top end surface 202T and a bottom end surface 202B. It also has two laterally opposite planar parallel planar side surfaces 202S. The auxiliary pillow 202 is about 32 cm wide, about 4 cm tall at its highest point, and about 66 cm long in the lateral direction.

The auxiliary pillow's top surface 202T follows the second pattern P2 of the main pillow's bottom surface 201B. Therefore, the auxiliary pillows' top surface 202T, 202T' can interleavingly mate (dovetail) with each other when one of them is vertically inverted, whether or not it is flipped longitudinally. Also, therefore, each auxiliary pillow's top surfaces 202T can interleavingly dovetail with any one of the main pillows' bottom surface 202B when one of them is vertically inverted, whether or not the other is flipped longitudinally.

The auxiliary pillow's bottom surface 202B follows a longitudinally undulating third pattern P3. The third pattern P3 is less pronounced than the first pattern P1. The third pattern P3 is longitudinally uniform in that it is substantially a flat-topped sine-wave, with a repeating trapezoidal motif. The repeating motif has a uniform amplitude and period, and is centered on a straight longitudinal line 218. The third pattern P3 is configured for the auxiliary pillows' bottom surfaces 202B, 202B' to interleavingly dovetail with each other when one of them is vertically inverted, whether or not the other is flipped longitudinally.

Since the shapes of both the main pillow 201 and the auxiliary pillow 202 are laterally uniform with flat parallel vertical sides 201S, both pillows 201, 202 can be formed by extrusion and cut to any desired length.

The shapes of the pillows 201, 201', 202, 202' enable a user to assemble a wide variety of pillow assemblies (pillow combinations, composite pillows), with different heights and with different slopes of the resulting top surface 220 and with different textures (either P1, P2 or P3) of the resulting top surface 220.

For each pillow assembly (combination of the pillows 201, 202) yielding a sloped resulting top surface 220, the user may rest his/her head in a forward orientation with the top surface sloping downward away from the user's neck and in an reverse orientation in which the resulting top surface slopes downward toward the user's neck. Also, each pillow assembly's top surface 220 may have any of three different possible patterns (P1, P2 or P3). So the user may choose between three possible patterns to lay his/her head on. Besides resting each pillow assembly being used to rest the user's head, it may be used to resting anything else. For example, a pillow assembly may be used as a foot rest, with feet extending in the lateral direction.

In each pillow combination, the undulations of mating surfaces (of either P1, P2 or P3) keep mating pillows from sliding longitudinally, and the dovetailing resists lateral sliding of each pillow over the other. This is especially true for the P1 pattern, in which each projection 210 of one main pillow 201 has a bulbous section 212 that is locked in place between adjacent necks 211' of the other main pillow 201'. Also, with any of the resulting combinations, the undulations (P1, P2, P3) provide air circulation under the user's head, or any body part resting on them.

In each pillow combination, the side surfaces 201S, 201S', 202S, 202S' of the two or more pillows are coextensive, so as to form one planar side surface on one side of the composite pillow and another planar side surface at the laterally opposite side of the composite pillow. Also, as shown in FIG. 10, the auxiliary pillow's front surface 202F is coextensive with the main pillow's rear surface 201R to form a smoothly rounded concave composite surface, and the auxiliary pillow's rear surface 202R is coextensive with the main pillow's front surface 201F to form a smoothly rounded concave composite surface. Similarly, as shown by the top auxiliary pillow of FIG. 14, the auxiliary pillow's front surface 202F is coextensive with the main pillow's front surface 201F to form a smoothly rounded concave composite surface, and the auxiliary pillow's rear surface 202R is coextensive with the main pillow's rear surface 201R to form a smoothly rounded concave composite surface.

Some example pillow combinations (assemblies) are as follows.

FIG. 10 shows a first four-piece composite pillow 200, in which the taller end 202F, 202F' of each auxiliary pillow 202, 202' is adjacent the shorter end 201R, 201R' of the adjoining main pillow 201, 201'. This arrangement yields a horizontal (non-sloping) top surface 220. This is well suited as a foot rest.

Figure 13:
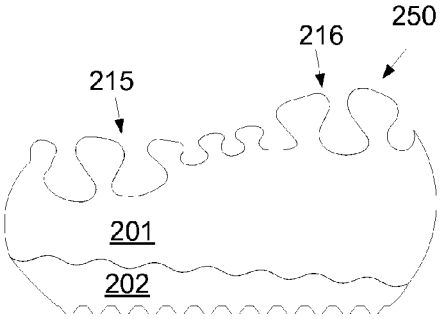
FIGS. 13-15 are side views of other pillow assemblies that can be assembled from the pillows shown in FIG. 10.

FIG. 13 shows a two-piece composite pillow comprising the main pillow 201 and the auxiliary pillow 202, with the taller end of one overlying the shorter end of the other. This composite pillow 250 may be oriented in either of two longitudinally opposite orientation, so that the user's head can lie on the lower concave section 215 or on the higher convex section 216 section. And this composite pillow 250 may be oriented in either of two vertically opposite orientations.

Alternatively, the user's head may lie on only the main pillow 201 (FIG. 12). The main pillow 201 may be oriented in either of two vertical orientations (i.e., upright orientation 201 in FIG. 12 or inverted orientation 201' in FIG. 12) and either of two longitudinal orientations (e.g., with the user's neck adjacent the front end 201F or adjacent the rear surface 201R).

Alternatively, the user's head may lie on only the auxiliary pillow 202 (FIG. 12). The auxiliary pillow 202 may be oriented in either of two vertical orientations (i.e., upright orientation 202 in FIG. 12 or inverted orientation 202' in FIG. 12) and either of two longitudinal orientations (e.g., with the user's neck adjacent the front end 202F or adjacent the rear surface 202R).

Figure 14:
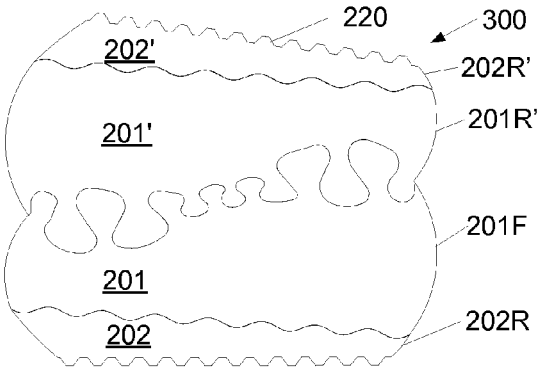

FIG. 14 shows a second four-piece composite pillow 300, which differs from the first four-piece composite pillow 200 in that the top auxiliary pillow 202' is flipped longitudinally so that its shorter end 202R' is adjacent the shorter end 201R of the main pillow 201' below it. This arrangement yields a sloping top surface 220.

Figure 15:
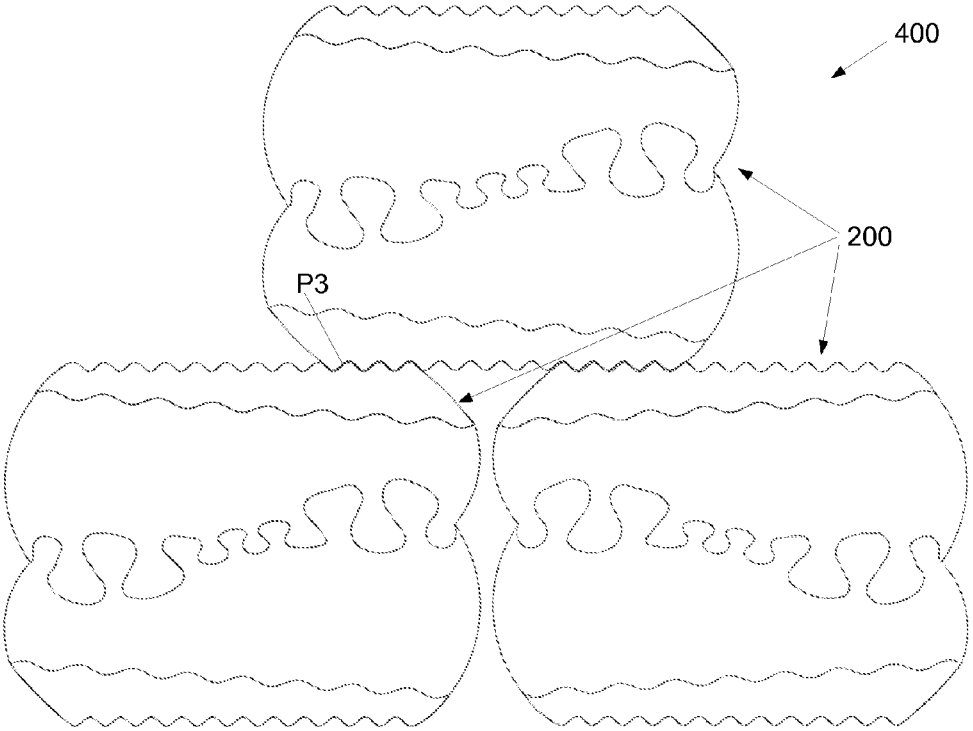

FIG. 15 shows a twelve-piece composite pillow 400 in which three four-piece composite pillows 200, like that of FIG. 10, are stacked together. In this configuration, interleaving of the third pattern P3 of the different composite pillows 200 keeps the composite pillows 200 from slipping apart.

In another composite, two or more auxiliary pillows 202 (FIG. 12) may be stacked together, alternating auxiliary pillows 202 vertically inverted so as to render P2 patterns dovetailed together and P3 patterns dovetailed together.

In fact, the user may assemble a composite pillow from any combination of main pillows 201, any combination of auxiliary pillows 202, and any combination of both main and auxiliary pillows 201, 202, as long as P1 patterns dovetail together, P2 patterns dovetail together, and P3 patterns dovetail together. When dovetailing one P1 surface with another, the two P1 surfaces have be to longitudinally aligned for the dovetailing to succeed. In contrast, when dovetailing one P2 surface with another, or dovetailing one P3 surface with another, the surfaces do not must be longitudinally aligned since the P2 and P3 patterns are longitudinally uniform along their lengths. This is illustrated in FIG. 15, in which one P3 surface straddles two P3 surfaces that are below it and is significantly longitudinally offset from the P3 surface of each one below it.

The components and procedures described above provide examples of elements recited in the claims. They also provide examples of how a person of ordinary skill in the art can make and use the claimed invention. They are described here to provide enablement and best mode without imposing limitations that are not recited in the claims. In some instances in the above description, a term is followed by a substantially equivalent term enclosed in parentheses.

The invention claimed is:

1. A mattress comprising:

a core that has a front end and a rear end that are spaced apart in a longitudinal direction and that has opposite sides that are spaced apart in a lateral direction, the core including:

a firmer lower core section having a top surface that follows an undulating pattern, wherein the undulating pattern is nonuniform and nonsymmetric in the longitudinal direction, is uniform in the lateral direction, and includes at least one hill, at least one valley and at least one plateau; and a softer upper core section that overlies the lower core section, the upper core section having a bottom surface that follows the undulating pattern and matingly contacts the lower core section's top surface to provide a common mating interface that follows the undulating pattern, wherein the interface includes at least one hill, at least one valley and at least one plateau;

a flexible encasement configured to encase the core, the encasement comprising a top panel, a bottom panel, a front panel, a rear panel, and two opposite side panels, wherein each panel is electrically conductive, flame retardant and antibacterial;

an electrical terminal attached to the encasement; and a cable having:

a first terminal configured to be connected to the electrical terminal, and an opposite second terminal configured to be plugged into a grounding terminal of a wall socket.

2. The mattress of claim 1, further comprising:

a flexible topper comprising a pad having the same peripheral size and shape as the encasement's top panel, the topper being configured to overlie the encasement's top panel;

a first zipper half extending along about the periphery of the topper; and a second zipper half, configured to mate with the first zipper half, extending about the periphery of the encasement's top panel, such that zipping the first zipper half to the second zipper half attaches the topper to the encasement with the encasement's top panel sandwiched between the topper and the core, and such that unzipping the first zipper half from the second zipper half detaches the topper from the encasement without opening the encasement.

3. The mattress of claim 1, further comprising:

a series of laterally-extending external upper grooves projecting downward from the upper core section's top surface; and air channels extending, within the core, downward from at least one of the external upper grooves.

4. The mattress of claim 1, further comprising:

an indication configured to indicate to a user which section, from among the upper core section and the lower core section, is the firmer section, wherein the indication includes both text and a color difference between the upper section and the lower section.

5. The mattress of claim 1, wherein the core includes a color boundary along the mating interface that follows the nonuniform nonsymmetric undulating pattern, and wherein the color boundary is defined by a difference in color between the softer upper core section and the firmer lower core section, such that the color boundary along the mating interface corresponds to a graph of firmness versus longitudinal position along the core, where the height of the color boundary at any given location along the core is a function of firmness at that location.

6. The mattress of claim 1, further comprising:

an indication indicating the user's head being adjacent the core's front end if the softer core section is on top, and indicating the user's feet being adjacent the core's front end if the firmer core section is on top.

7. The mattress of claim 1, wherein the encasement wherein the top panel is softer than the bottom panel, and the encasement include a zipper that enables opening the encasement to remove and insert the core, wherein the encasement is configured for a user to unzip the zipper to open the encasement, remove the core from the encasement, invert the core, and insert the core back into the encasement;

for the mattress to provide four user-selectable levels of firmness comprising: (i) an extra soft level achieved by the softer upper core section and the softer upper panel on top, (ii) a medium soft level achieved by the softer upper core section and the firmer bottom panel on top, (iii) a medium firm level achieved by the firmer lower core section and the softer top panel on top, and (iv) an extra firm level achieved by the firmer lower core section and the firmer bottom panel on top.

8. A mattress comprising:

a core that has a front end and a rear end that are spaced apart in a longitudinal direction and that has opposite sides that are spaced apart in a lateral direction, the core including:

a firmer lower core section having a top surface that follows an undulating pattern, wherein the undulating pattern is nonuniform and nonsymmetric in the longitudinal direction, is uniform in the lateral direction, and includes at least one hill, at least one valley and at least one plateau; and a softer upper core section that overlies the lower core section, the upper core section having a bottom surface that follows the undulating pattern and matingly contacts the lower core section's top surface to provide a common mating interface that follows the undulating pattern, wherein the interface includes at least one hill, at least one valley and at least one plateau; and a flexible encasement configured to encase the core, the encasement comprising a top panel, a bottom panel, a front panel, a rear panel, two opposite side panels, and a zipper that enables opening the encasement to remove and insert the core;

a flexible topper comprising a pad having the same peripheral size and shape as the encasement's top panel, the topper being configured to overlie the encasement's top panel;

a first zipper half extending about the periphery of the topper; and a second zipper half, configured to mate with the first zipper half, extending about the periphery of the encasement's top panel, such that zipping the first zipper half to the second zipper half attaches the topper to the encasement with the encasement's top panel sandwiched between the topper and the core, and such that unzipping the first zipper half from the second zipper half detaches the topper from the encasement without opening the encasement.

9. The mattress of claim 8 further comprising:

a third zipper half, configured to mate with the first zipper half, extending about the periphery of the encasement's bottom panel, such that zipping the first zipper half to the third zipper half attaches the topper to the encasement with the encasement's bottom panel sandwiched between the topper and the core, and such that unzipping the first zipper half from the third zipper half detaches the topper from the encasement without opening the encasement.

10. The mattress of claim 8, further comprising:

an electrical terminal attached to the encasement; and a cable having:

a first terminal configured to be connected to the electrical terminal, and an opposite second terminal configured to be plugged into a grounding terminal of a wall socket.

11. The mattress of claim 8, further comprising:

a series of laterally-extending external upper grooves projecting downward from the upper core section's top surface; and air channels extending, within the core, downward from at least one of the external upper grooves.

12. The mattress of claim 8, further comprising:

an indication configured to indicate to a user which section, from among the upper core section and the lower core section, is the firmer section, wherein the indication includes both text and a color difference between the upper section and the lower section.

13. The mattress of claim 8, wherein the core includes a color boundary along the mating interface that follows the nonuniform nonsymmetric undulating pattern, and wherein the color boundary is defined by a difference in color between the softer upper core section and the firmer lower core section, such that the color boundary along the mating interface corresponds to a graph of firmness versus longitudinal position along the core, where the height of the color boundary at any given location along the core is a function of firmness at that location.

14. The mattress of claim 8, further comprising:

an indication indicating the user's head being adjacent the core's front end if the softer core section is on top, and indicating the user's feet being adjacent the core's front end if the firmer core section is on top.

15. The mattress of claim 8, wherein the encasement wherein the top panel is softer than the bottom panel, and the encasement include a zipper that enables opening the encasement to remove and insert the core, wherein the encasement is configured for a user to unzip the zipper to open the encasement, remove the core from the encasement, invert the core, and insert the core back into the encasement;

for the mattress to provide four user-selectable levels of firmness comprising: (i) an extra soft level achieved by the softer upper core section and the softer upper panel on top, (ii) a medium soft level achieved by the softer upper core section and the firmer bottom panel on top, (iii) a medium firm level achieved by the firmer lower core section and the softer top panel on top, and (iv) an extra firm level achieved by the firmer lower core section and the firmer bottom panel on top.

* * * * *